US006314691B1

(12) United States Patent
Takagi et al.

(10) Patent No.: US 6,314,691 B1
(45) Date of Patent: Nov. 13, 2001

(54) INSPECTION OPENING FRAME

(75) Inventors: Kyozaburo Takagi, Centerville, OH (US); Kazuhiko Kise, Funabashi; Shinjiro Yagi, Ota-ku, both of (JP)

(73) Assignee: Fukuvi Chemical Industry Co., Ltd, Fukui (JP)

( * ) Notice: Subject to any disclaimer, the term of this patent is extended or adjusted under 35 U.S.C. 154(b) by 0 days.

(21) Appl. No.: 09/459,991

(22) Filed: Dec. 14, 1999

(30) Foreign Application Priority Data

Dec. 14, 1998 (JP) ..... 10-354952

(51) Int. Cl.[7] ..... E04C 2/52

(52) U.S. Cl. ..... 52/220.1; 52/205; 52/206; 52/207; 52/210; 52/211; 52/204.51; 52/208; 52/204.71; 52/204.53; 52/762; 49/504; 16/225

(58) Field of Search ..... 52/205, 206, 207, 52/210, 211, 204.51, 208, 204.1, 204.53, 220.1, 762; 160/369, 371, 377; 49/504; 16/225

(56) References Cited

U.S. PATENT DOCUMENTS 5,433,054 * 7/1995 Langenhorst ..... 52/656.9

FOREIGN PATENT DOCUMENTS 59147843 10/1984 (JP) .
0217075 5/1990 (JP) .

* cited by examiner

*Primary Examiner*—Carl D. Friedman
*Assistant Examiner*—Dennis L. Dorsey
(74) *Attorney, Agent, or Firm*—Smith Patent Office

(57) ABSTRACT

An inspection opening frame includes frame components each of which is provided with a support portion extending along the inner surface of an inspection opening, a front wall holding portion projecting outward from the front surface of the support portion, a rear lid holding portion projecting inward from the rear surface of the support portion, a front lid holding portion projecting inward from the front surface of the support portion and pivotally supported about a hinge, a rear wall holding portion projecting outward from the rear surface of the support portion and pivotally supported about another hinge, and locking portions each having a hook and a projection for disengageably locking the front lid holding portion and the rear wall holding portion in holding positions. The inspection opening frame can be easily mounted at the inspection opening without using a backing or the like.

14 Claims, 8 Drawing Sheets

INSPECTION OPENING FRAME

This application is based on patent application No. 10-354952 filed in Japan, the contents of which are hereby incorporated by references.

BACKGROUND OF THE INVENTION

This invention relates to a frame to be mounted at an inspection opening for inspecting a piping arranged inside of an enclosure member defining a wall or ceiling of a house or building.

A known inspection opening frame is disclosed, for example, in Japanese Examined Utility Model Publication No. 2-17075. This frame is provided with a mount plate to be mounted on a mount member such as a backing; a supporting plate projecting from the mount plate by the thickness of a plate member such as a wall plate; a holding portion which is so provided at an end of the supporting plate as to extend in a direction normal thereto, holds the plate member in cooperation with the mount plate at its one end, and is formed with an engaging portion at its other end; and a cover which is continuously and rotatably provided at one end of the holding portion via its hinge, has a locking projection engageable with and disengageable from the engaging portion formed on its surface facing the holding portion, and covers the outer circumferential portion of an inspection opening lid. The inspection opening lid is detachably tightly held between the cover and the mount plate. With this construction, the inspection lid can be attached and detached without using screws.

The inspection lid can be attached and detached without using screws with the inspection opening frame disclosed in the above publication. However, since the mount plate of the inspection opening frame is secured to a wooden backing assembled in advance to have a square shape by screws after the backing is arranged on the rear side of a wall surface on which the inspection opening frame is to be mounted, this operation is disadvantageously cumbersome.

SUMMARY OF THE INVENTION

It is an object of the invention to provide an inspection opening frame which has overcome the problems residing in the prior art.

According to an aspect of the invention, an inspection opening frame is mountable at an inspection opening formed in an enclosure member to hold a lid. The inspection opening frame comprises at least one frame component including: a support portion extending along an inner surface of the inspection opening; a first enclosure member holding portion extending along one surface of the enclosure member and having a part operable to come into contact with the one surface of the enclosure member; a second enclosure member holding portion extending along the opposite surface of the enclosure member and having a part operable to come into contact with the opposite surface of the enclosure member, the second enclosure member holding portion being pivotally supported on the support portion; a first lid holding portion extending along one surface of the lid and having a part operable to come into contact with the one surface of the lid; and a first locking portion for disengageably locking the second enclosure member holding portion.

It may be preferable that the frame component is further provided with a second lid holding portion extending along the opposite surface of the lid and having a part operable to come into contact with the opposite surface of the lid, the second lid holding portion being pivotally supported on the support portion; and a second locking portion for disengageably locking the second lid holding portion.

These and other objects, features and advantages of the present invention will become more apparent upon a reading of the following detailed description and accompanying drawings.

DETAILED DESCRIPTION OF THE PREFERRED EMBODIMENTS OF THE INVENTION

Figure 1:
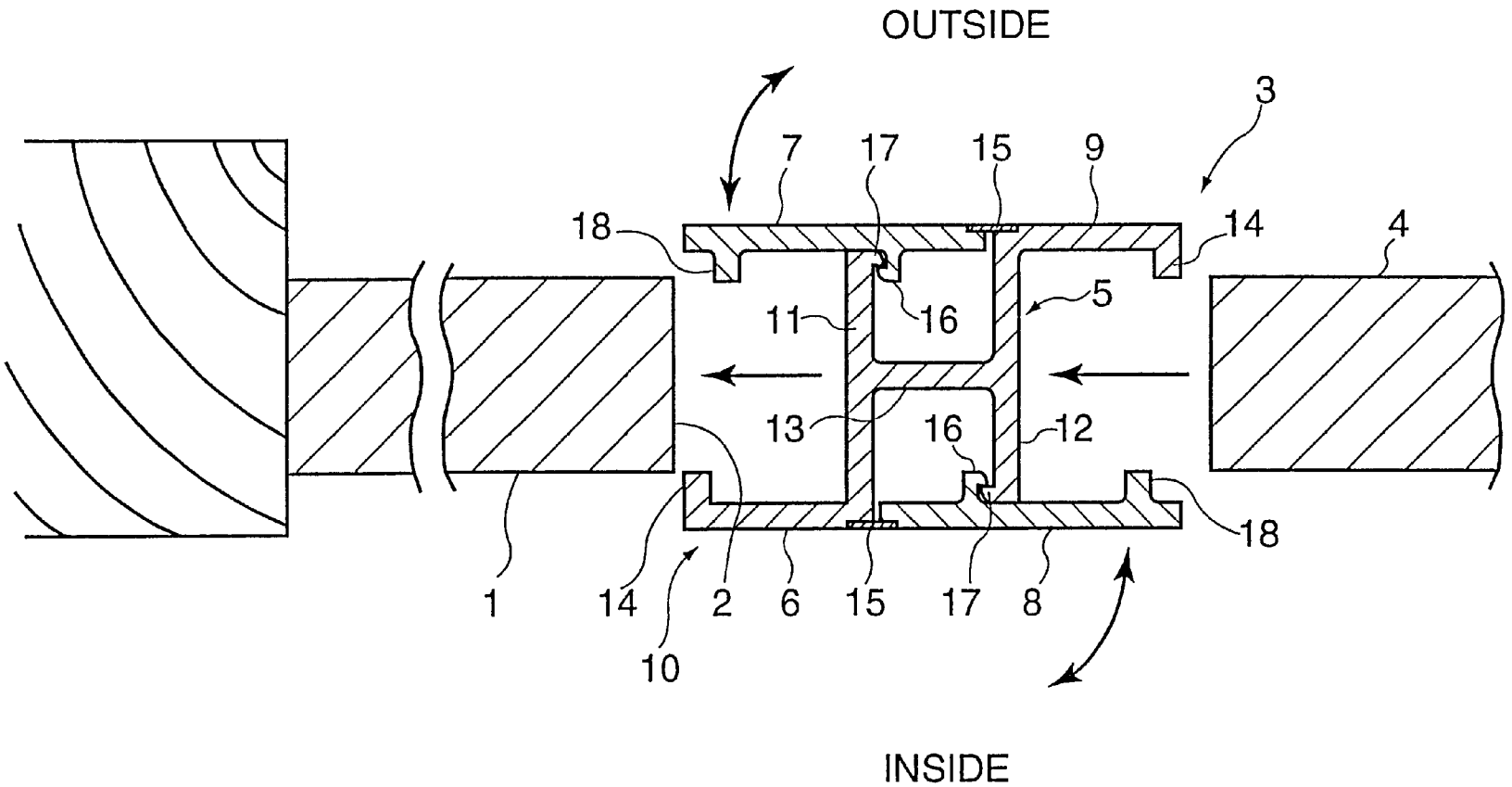
FIG. 1 is a sectional view of an inspection opening frame according to an embodiment of the invention.
Figure 2:
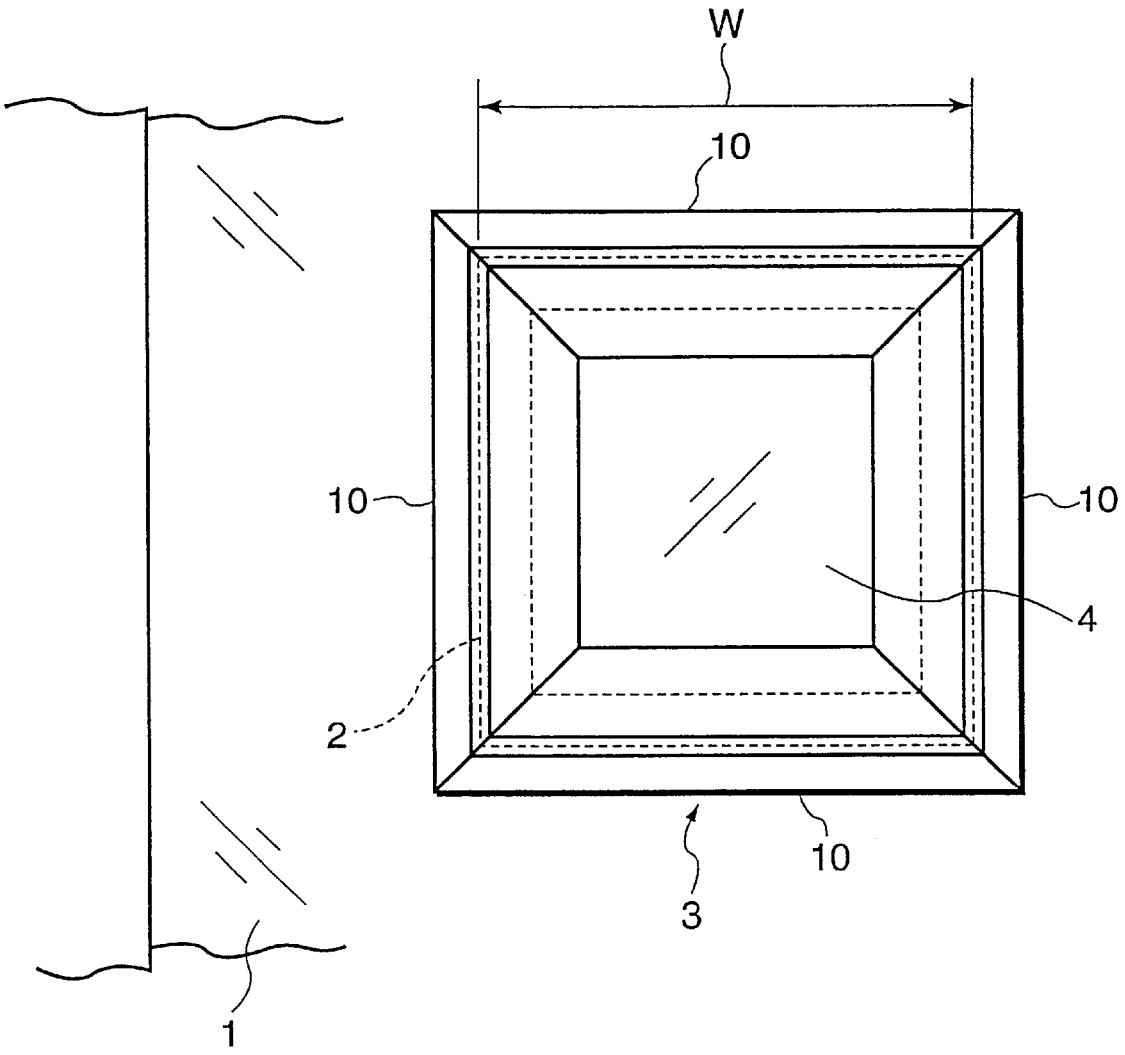
FIG. 2 is a front view of the inspection opening frame in its mounted state.
Figure 3:
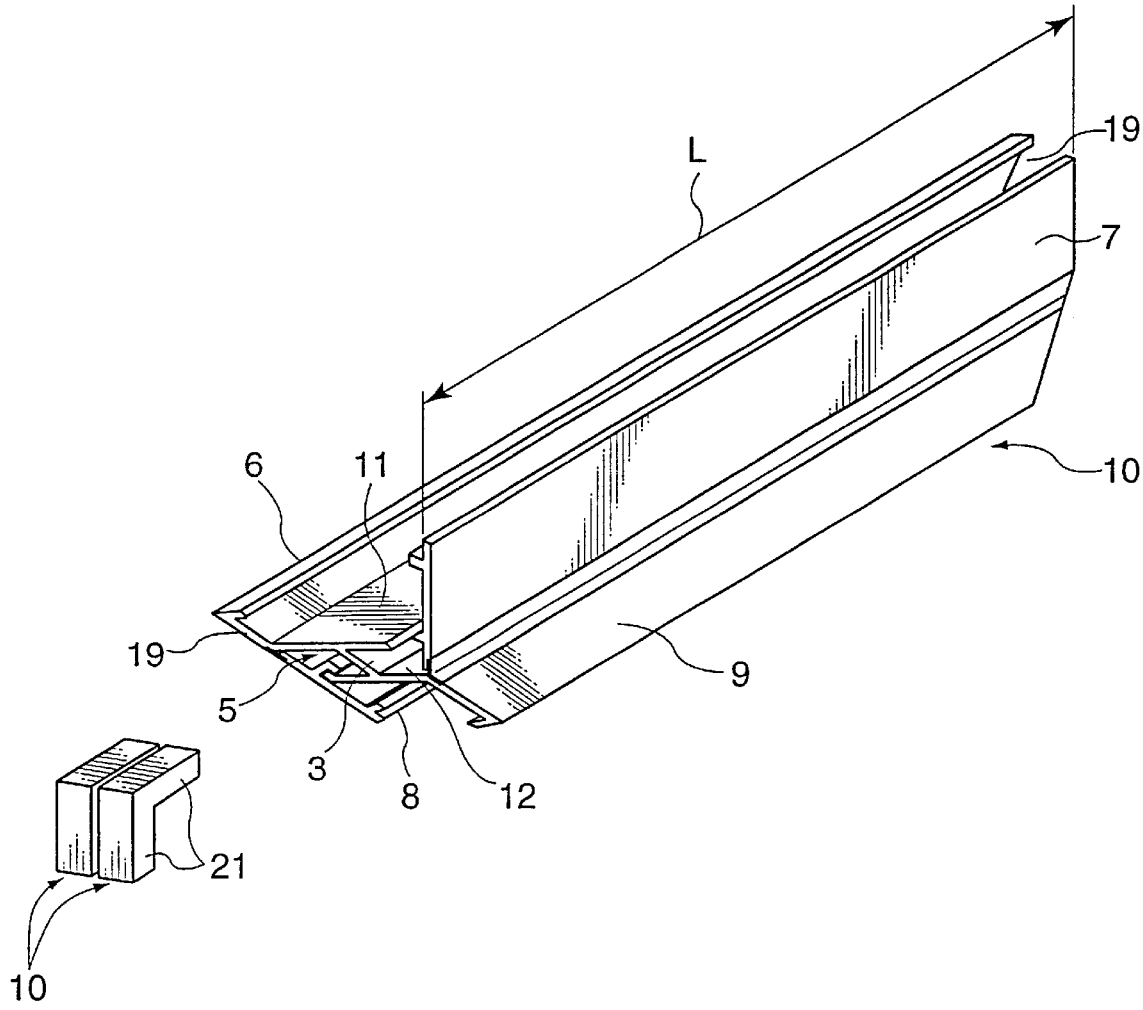
FIG. 3 is a perspective view showing a specific construction of a frame component.

FIGS. 1 to 3 show an inspection opening structure including an inspection opening frame according to an embodiment of the invention. This structure is provided with an inspection opening 2 formed in a wall member (i.e., enclosure member) 1 such as a gypsum board or wall plate provided at a wall or ceiling of a housing or building, an inspection opening frame 3 to be mounted at the inspection opening 2, and an inspection opening lid 4 for closing the inspection opening 2 by being held by the inspection opening frame 3.

The inspection opening frame 3 is comprised of frame components 10 each including a support portion 5 extending along the inner surface of the inspection opening 2, a pair of front and rear wall holding portions 6, 7 projecting radially outward from the support portion 5, i.e., in directions away from the center of the inspection opening 2, and a pair of front and rear lid holding portions 8, 9 projecting radially inward from the support portion 5, i.e., in directions toward the center of the inspection opening 2.

The support portion 5 is comprised of outer and inner side plates 11, 12 extending in parallel while being spaced apart by a specified distance, and a coupling plate 13 coupling the centers of the outer and inner side plates 11, 12 with respect to widthwise direction and, therefore, has a H-shaped cross section. The front wall holding portion 6 projects radially outward from the front surface of the outer side plate 11 located at an indoor side of the support portion 5, and the front lid holding portion 8 projects radially inward therefrom. Further, the rear wall holding portion 7 projects radially outward direction from the rear surface of the inner side plate 12 located at an outdoor side of the support portion 5, and the rear lid holding portion 9 projects radially inward therefrom.

The front wall holding portion 6 and the rear lid holding portion 9 are unitarily formed with the outer and inner side plates 11, 12 of the support portion 5, respectively. Elongated projections 14 which acts as contact portions to be pressed against surfaces to be tightly held are provided at the leading ends of the holding portions 6, 9. The holding portions 6, 9 are so formed as to have the same shape and symmetrically arranged with respect to the support portion 5.

The rear wall holding portion 7 and the front lid holding portion 8 are pivotally provided as shown in arrows of FIG. 1 by being connected with the outer and inner side plates 11, 12 via hinges 15 formed of a flexible material, respectively. The holding portions 7, 8 may be pivotally supported by thinning the hinges 15. The holding portions 7, 8 are so formed as to have the same shape and symmetrically arranged with respect to the support portion 5.

Hooks 16 each having a head portion for engagement project from the holding portions 8, 7, whereas projections 17 engageable with the head portions of the hooks 16 are provided at the ends of the outer and inner side plates 11, 12 of the support portion 5. The hooks 16 and the projections 17 are each formed with an arcuate engagement guide surface. The holding portions 7, 8 are disengageably locked in their holding positions where they tightly hold the wall 1 and the inspection opening lid 4 by locking portions constructed by the hooks and the projections 17. Further, elongated projections 18 which acts as contact portions to be pressed against surfaces to be tightly held are provided in vicinity of the leading ends of the holding portions 7, 8.

At ends of each frame component 10 are formed corner slanted portions 19 which are slanted at about 450 as shown in FIG. 2. The ends of the frame components 10 are connected by coupling members 20 with the corner slanted portions of the adjacent frame components 10 held in abutment against each other. Each coupling member 20 is comprised of a pair of L-shaped push-in portions 21 as shown in FIG. 3. The push-in portions 21 are pushed into spaces defined between the outer side plates 11, the inner side plates 12 and the coupling plates 13 of the support portions 5 of the frame components 10 to connect the ends of the adjacent frame components.

Each rear wall holding portion 7 has its opposite ends cut such that its length L corresponds to a width W of the inspection opening 2, i.e., is equal to or slightly shorter than the width W.

Figure 4:
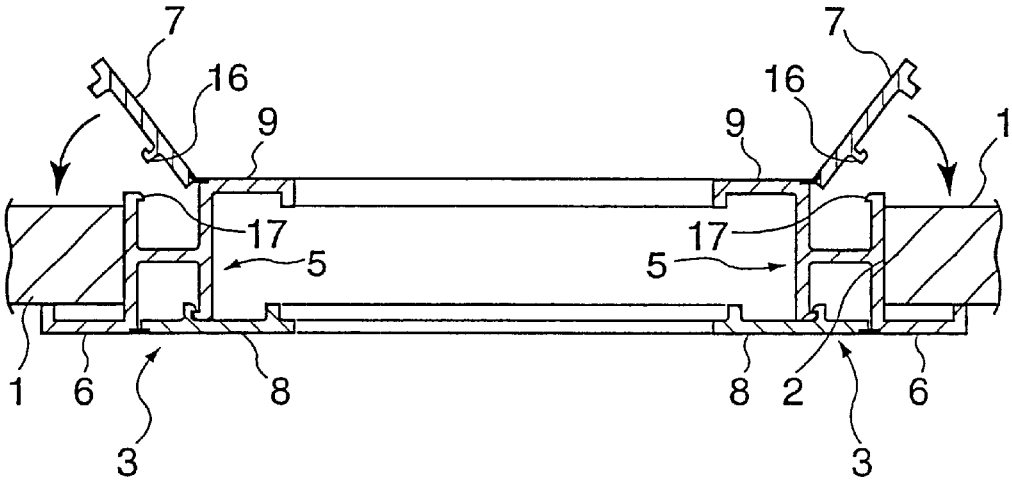
FIG. 4 is a sectional view showing a first stage of an inspection opening frame mounting method.
Figure 5:
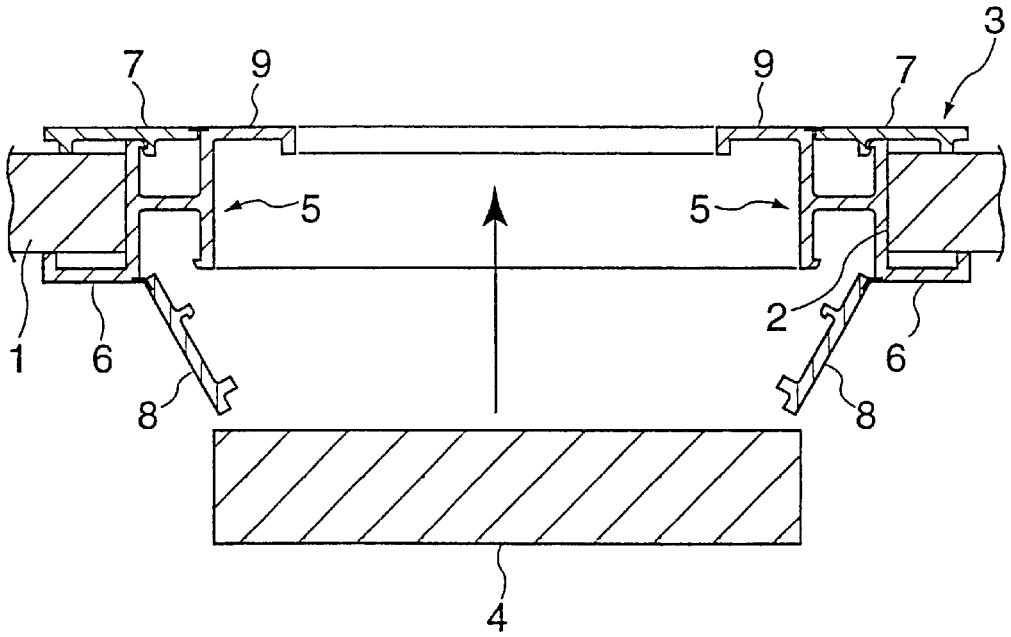
FIG. 5 is a sectional view showing a second stage of the inspection opening frame mounting method.
Figure 6:
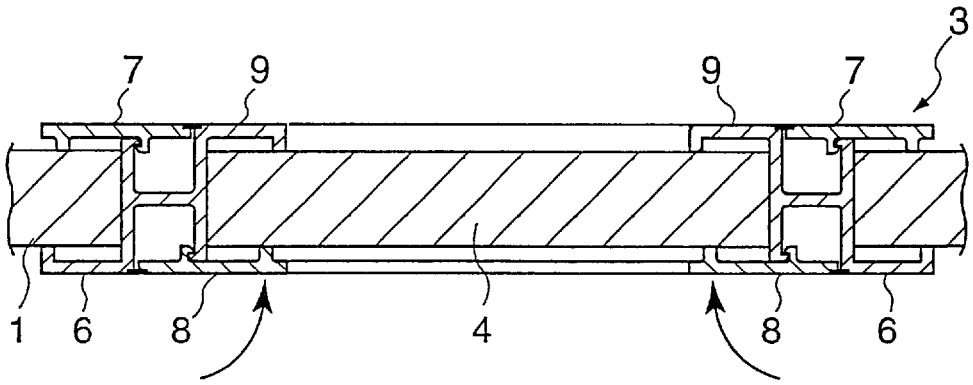
FIG. 6 is a sectional view of the inspection opening frame in its mounted state.

The inspection opening frame 3 is mounted on a wall as follows. First, the inspection opening frame 3 is formed by coupling the ends of four frame components 10 by the coupling members 20. Thereafter, as shown in FIG. 4, the locked state of the rear wall holding portions 7 by the locking portions comprised of the hooks 16 and the projections 17 is canceled to pivotally displace the holding portions 7 to their open positions. In this state, the holding portions 7 and the rear lid holding portions 9 are inserted into the inspection opening 2 from the indoor side, thereby displacing the support portions 5 to positions along the inner surface of the inspection opening 2.

Subsequently, the rear wall holding portions 7 are pivotally displaced to their closed positions and locked there to tightly hold the wall 1. In this way, the inspection opening frame 3 is mounted on the wall 1. Thereafter, the locked state of the front lid holding portions 8 by the locking portions is canceled and are pivotally displaced to their open positions. In this state, the inspection opening lid 4 is inserted into the inspection opening frame 3 from the indoor side. Then, the rear wall holding portions 7 are pivotally displaced to their closed positions and locked there to tightly hold the inspection opening lid 4. In this way, the inspection opening lid 4 is held by the front and rear lid holding portions 8, 9.

As described above, the inspection opening frame 3 mounted at the inspection opening 2 formed in the wall 1 to hold the inspection opening lid 4 is comprised of the frame components 10, each including the support portion 5 extending along the inner surface of the inspection opening 2, the front wall holding portion 6 projecting radially outward from the front surface of the support portion 5, the rear lid holding portion 9 projecting radially inward from the rear surface of the support portion 5, the front lid holding portion 8 projecting radially inward from the front surface of the support portion 5 and pivotally supported about the hinge 15, the rear wall holding portion 7 projecting radially outward from the rear surface of the support portion 5 and pivotally supported about the hinge 15, the locking portion including the hook 16 and the projection 17 for disengageably locking the front lid holding portion 8 in such a position as to tightly hold the inspection opening lid 4, and the another locking portion including the hook 16 and the projection 17 for disengageably locking the rear wall holding portion 7 in such a position as to tightly hold the wall 1. Accordingly, the inspection opening frame 3 can be easily mounted at the inspection opening 2 of the wall 1 without necessitating a cumbersome operation of fastening the inspection opening frame 3 by screws using a backing as in the prior art inspection opening frame.

More specifically, the inspection opening frame 3 can be mounted on the wall 1 only by inserting the rear wall holding portions 7 and the rear lid holding portions 9 into the inspection opening 2 from the indoor side after the rear wall holding portions 7 are pivotally displaced to their open positions, and by locking the rear wall holding portions 7 in their positions to tightly hold the wall 1 by pivotally displacing them from their open positions to their closed positions after the support portions 5 are mounted in positions along the inner surface of the inspection opening 2. Further, the inspection opening lid 4 can be tightly held by the front and rear lid holding portions 8, 9 only by inserting the inspection opening lid 4 into the opening of the inspection opening frame 3 after the front lid holding portions 8 are pivotally displaced to their open positions, and then by locking the front lid holding portions 8 in their positions to tightly hold the inspection opening lid 4 by pivotally displacing them from their open positions to their closed positions.

In this embodiment, the front lid holding portions 8 and the rear wall holding portions 7 have the same shape and are symmetrically arranged with respect to the support portions 5, and the front wall holding portions 6 and the rear lid holding portions 9 have the same shape and are symmetrically arranged with respect to the support portions 5. Accordingly, the front lid holding portions 8 and the front wall holding portions 6 can be used as the rear wall holding portions 7 and the rear lid holding portions 9, respectively, by turning the frame components 10 inside out. Therefore, the frame components 10 can be advantageously formed by cutting an elongated piece to a specified length without distinguishing the front and rear sides.

Further, if the length L of the rear wall holding portions 7 is set at a value corresponding to the width W of the opening of the inspection opening 2 as described in the above embodiment, the interference thereof with the inner surface of the inspection opening 2 can be prevented when the rear wall holding portions 7 provided at the rear side of the frame components 10 are inserted into the inspection opening 2. Accordingly, the inspection opening frame 3 assembled by coupling the respective frame components 10 can be easily mounted on the wall 1.

The ends of the respective frame components 10 may be adhered to each other by an adhesive. If the ends of the adjacent frame components 10 are connected by the coupling members 20 as in the above embodiment, there are advantages of an easy coupling operation without using an adhesive and a possibility to disassemble the inspection opening frame 3 by easily disconnecting the frame components 10.

Figure 7:
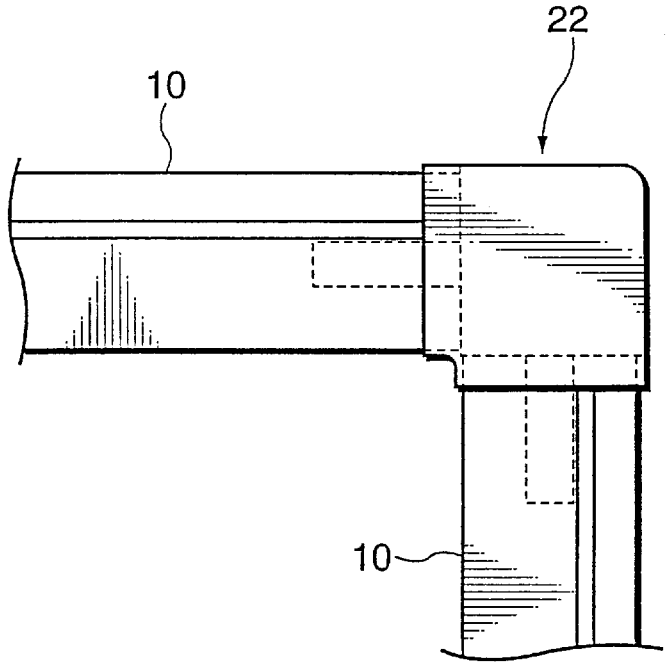
FIG. 7 is a partially plan view showing an inspection opening frame according to another embodiment of the invention.

Instead of the above embodiment in which the corner slanted portions 19 slanted at about 450 are formed at the ends of the frame components 10, and the frame components 10 are connected by the coupling members 20 with the corner slanted portions 19 thereof held in abutment against each other, the inspection opening frame 3 may be provided with corner members 22 constructing the coupling members to connect the ends of the adjacent frame components 10 as shown in FIG. 7.

Figure 8:
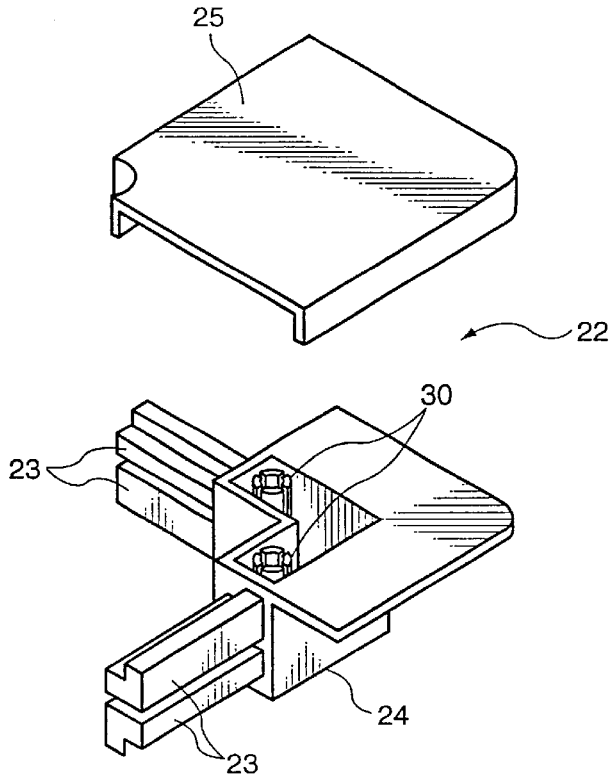
FIG. 8 is an exploded perspective view showing a specific construction of a corner member.
Figure 9:
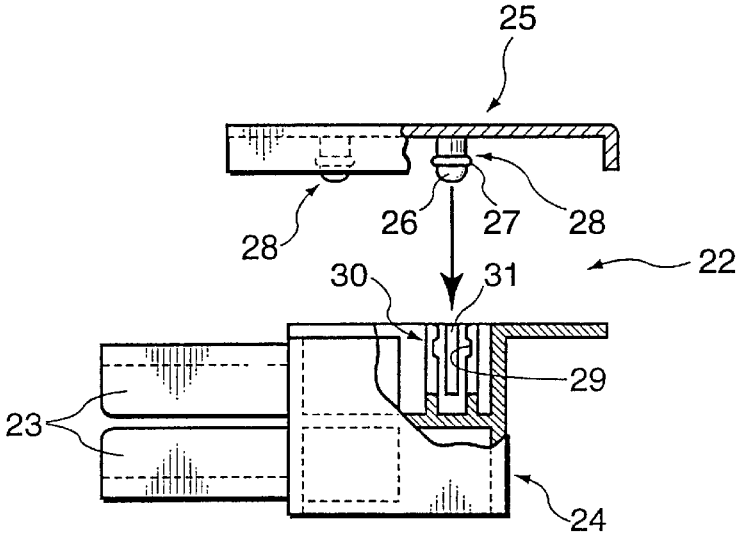
FIG. 9 is a sectional view showing a specific construction of the corner member.

Each corner member 22 is comprised of a corner member main body 24 formed with a pair of upper and lower push-in portions 23 projecting from two mutually orthogonal surfaces of the corner member main body 24, and a cover member 25 for covering the front surface of the corner member main body 24 as shown in FIGS. 8 and 9. The ends of the adjacent frame components 10 are connected by pushing the push-in portions 23 into the spaces formed in the support portions 5 of the frame components 10.

A pair of locking pins 28 each having a spherical guide portion 26 and a bulging rim 27 formed at its leading end project from the rear surface of the cover member 25. On the other hand, the corner member main body 24 includes tubular engaging portions 30 each formed with a groove 29 into the bulging rim 27 of the corresponding locking pin 28 is fittable.

The cover member 25 is detachably mounted on the corner member main body 24 by fitting the bulging rims 27 of the locking pins 28 into the grooves 29 of the engaging portions 30. Further, the engaging portions 30 of the corner member main body 24 are formed with slits 31 so that the bulging rims 27 can be easily fitted into the grooves 29.

Figure 10:
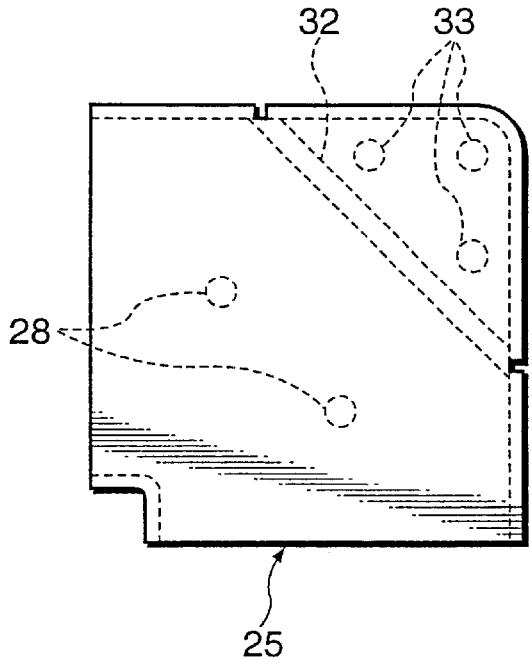
FIG. 10 is a plan view of another corner member.
Figure 11:
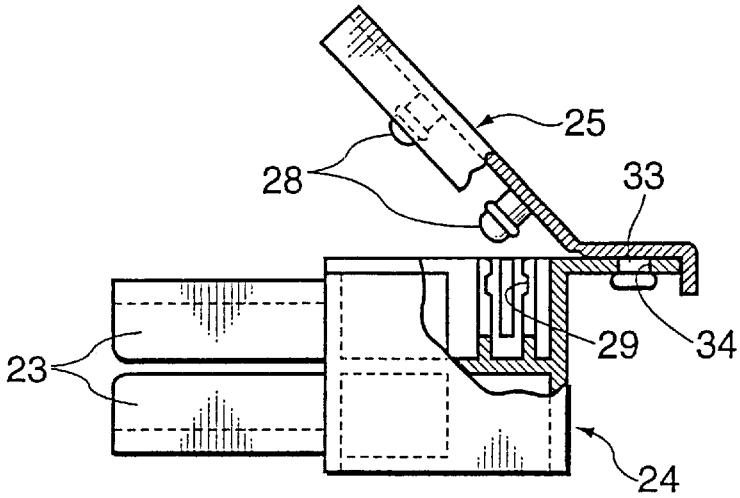
FIG. 11 is a sectional view showing a specific construction of the corner member of FIG. 10.

Although the separately formed corner member main body 24 and the cover member 25 are integrally connected when the inspection opening frame 3 is assembled in the above embodiment, the corner member main body 24 and the cover member 25 may be integrally formed. For example, as shown in FIG. 10, a hinge 32 is provided at a corner portion of the cover member 25 by thinning or making it of a flexible material, thereby pivotally supporting the corner portion. Protuberances 33 are formed on the rear surface of the corner portion. The corner member main body 24 and the cover member 25 may be formed into an integral construction by melting the leading ends of the protuberances 33 inserted into mount holes 34 formed in the corner member main body 24 to form bulging portions as shown in FIG. 11.

If the corner member rain body 24 and the cover member 25 are integrally formed as above, it eliminates an occurrence of a problem that they are separated during transportation or assembling and one of them is lost. After the frame components 10 are connected, the bulging rims 27 can be easily pushed into the grooves 29.

As another embodiment, an inspection opening frame 3 to be mounted at an inspection opening 2 formed in a ceiling member la (i.e., enclosure member) may be comprised of frame components 10, each including the support portion 5, a rear ceiling holding portion 7 projecting radially outward from the rear surface of the support portion 5, a lid supporting plate 30 projecting radially inward from the front surface of the support portion 5, a front ceiling holding portion 6 projecting radially outward from the front surface of the support portion 5 and pivotally supported about a hinge 15, a locking portion including a hook 16 and a projection 17 for disengageably locking the front ceiling holding portion 6 in such a position as to tightly hold the ceiling member 1*a*.

Figure 12:
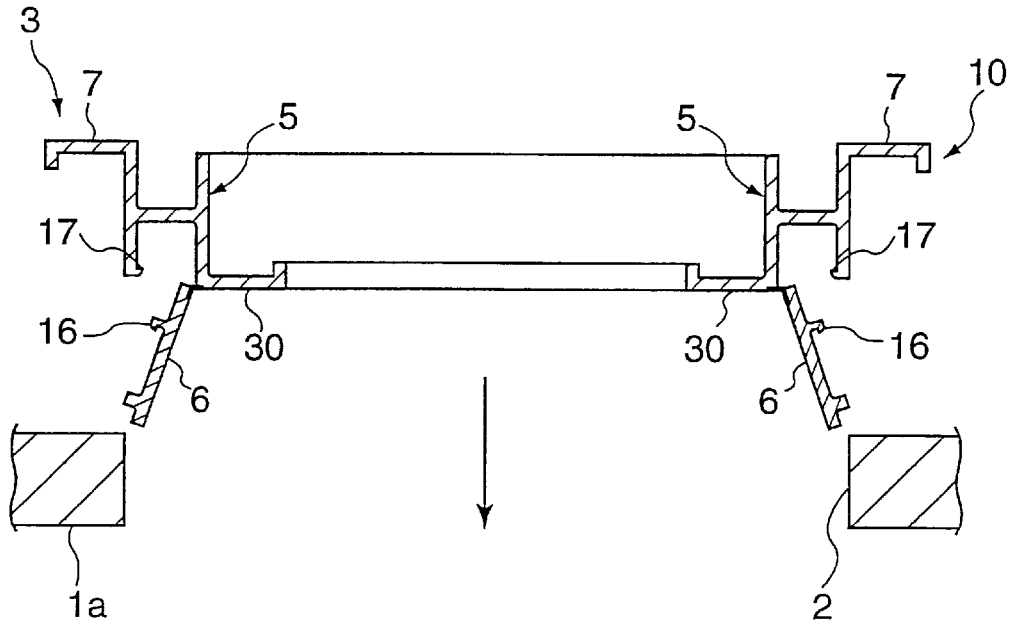
FIG. 12 is a sectional view showing an inspection opening frame according to still another embodiment of the invention.
Figure 13:
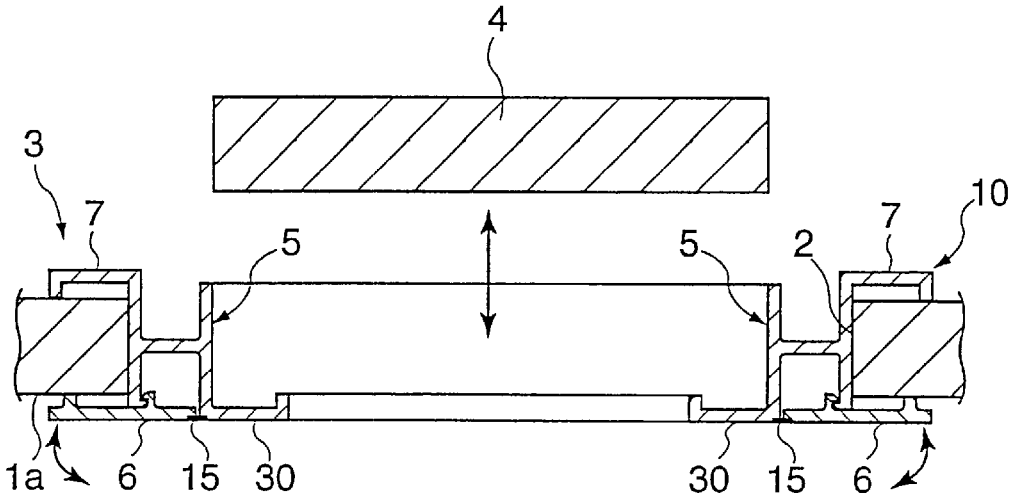
FIG. 13 is a sectional view showing a method for mounting the inspection opening frame of FIG. 12.

The inspection opening frame 3 is mounted at the inspection opening 2 formed in the ceiling member 1*a* as follows. After the inspection opening frame 3 is assembled by coupling a plurality of frame components 10 by the coupling members 20, the corner members 22 or the like, the locked states of the front ceiling holding portions 6 by the locking portions comprised of the hooks 16 and the projections 17 are canceled to pivotally displace the ceiling holding portions 6 to their open positions as shown in FIG. 12. In this state, the assembled inspection opening frame 3 is obliquely inserted through the inspection opening 2 to be located above the inspection opening 2.

After the support portions 5 are mounted along the inner surface of the inspection opening 2 by dropping the inspection opening frame 3 into the inspection opening 2, the inspection opening frame 3 is mounted on the ceiling member 1*a* by pivotally displacing the front ceiling holding portions 6 from their open positions to their closed positions and locking them there to tightly hold the ceiling member 1*a*. Subsequently, after being obliquely inserted through the opening of the inspection opening frame 3, the inspection opening lid 4 is placed on the lid supporting plates 30 to be held.

With the above construction, by integrally forming the support portion 5, the ceiling holding portion 7 and the lid supporting plate 30 of the frame component 10, the ceiling holding portion 7 and the lid supporting plate 30 are allowed to have a sufficient rigidity and strength. This effectively prevents an occurrence of an undesirable event where the ceiling holding portions 7 and the lid supporting plates 30 are pivotally displaced by the action of gravity due to the weights thereof to fall the inspection opening frame 3 and the inspection opening lid 4. Further, the inspection opening 2 can be easily made open by pushing up the inspection opening lid 4.

As described above, an inventive inspection opening frame to be mounted at an inspection opening formed in a wall to hold an inspection opening lid, is provided with frame components, each comprising a support portion extending along the inner surface of the inspection opening; a front wall holding portion projecting radially outward from the front surface of the support portion; a rear lid holding portion projecting radially inward from the rear surface of the support portion; a front lid holding portion projecting radially inward from the front surface of the support portion and pivotally supported about a hinge; a rear wall holding portion projecting radially outward from the rear surface of the support portion and pivotally supported about another hinge; a first locking portion for disengageably locking the front lid holding portion in a lid holding position; and a second locking portion for disengageably locking the rear wall holding portion in a wall holding position.

With this construction, the frame components are mounted on the wall while the front and rear wall holding portions are held in pressing contact with the wall by locking the rear wall holding portions by the first locking portions with the support portions arranged along the inner surface of the inspection opening. Further, the inspection opening lid is held by the front and rear lid holding portions by locking the front lid holding portions by the second locking portions with the support portions arranged along the inner surface of the inspection opening. Thus, the inspection opening frame can be easily mounted at the inspection opening without necessitating a cumbersome operation of fastening screws using a backing or the like as in the prior art.

Preferably, the inspection opening frame is formed by assembling a plurality of frame components, and ends of adjacent frame components are connected by coupling members. With this construction, the inspection opening frame to be mounted along the inner surface of the inspection opening is formed by coupling the ends of the adjacent frame components by the coupling members.

Preferably, the front lid holding portions and the rear wall holding portions have the same shape and are symmetrically arranged with respect to the corresponding support portions, and the front wall holding portions and the rear lid holding portions have the same shape and are symmetrically arranged with respect to the corresponding support portions. With this arrangement, the front lid holding portions can be used as the rear wall holding portions and the front wall holding portions can be used as the rear lid holding portions by turning the frame components inside out.

Preferably, the length of the rear wall holding portions are so set as to correspond to a dimension of the inspection opening. With this arrangement, the rear wall holding portions of the frame components can be inserted through the inspection opening without being interfered by the inner surface of the inspection opening. Accordingly, the operation of mounting the frame components on the wall by locking the wall holding portions by the second locking portions can be easily performed.

Another inventive inspection opening frame to be mounted at an inspection opening formed in a ceiling to hold an inspection opening lid, is provided with frame components, each comprising a support portion extending along the inner surface of the inspection opening; a rear ceiling holding portion projecting radially outward from the rear surface of the support portion; a lid supporting plate projecting radially inward from the rear surface of the support portion; a front ceiling holding portion projecting radially inward from the front surface of the support portion and pivotally supported about a hinge; and a locking portion for disengageably locking the front ceiling holding portion in a ceiling holding position.

With this construction, the frame components are mounted on the ceiling while the front and rear ceiling holding portions are held in pressing contact with the ceiling by locking the front ceiling holding portions by the locking portions with the support portions arranged along the inner surface of the inspection opening. Further, the inspection opening lid is held by being placed on the lid supporting plate by the action of gravity due to its weight. Thus, an occurrence of an undesirable event where the ceiling holding portions and the lid supporting plates are pivotally displaced by the action of gravity due to the weights thereof to fall the inspection opening frame and the inspection opening lid can be effectively prevented. Further, the inspection opening can be easily made open by pushing up the inspection opening lid.

As this invention may be embodied in several forms without departing from the spirit of essential characteristics thereof, the present embodiment is therefore illustrative an not restrictive, since the scope of the invention is defined by the appended claims rather than by the description preceeding them, and all changes that fall within metes and bounds of the claims, or equivalence of such metes and bounds are therefore intended to embraced by the claims.

What is claimed is:

1. An inspection opening frame mountable at an inspection opening formed in an enclosure member for holding a lid, comprising a frame component including:

a support portion extending along an inner surface of the inspection opening;

a first enclosure member holding portion extending along one surface of the enclosure member and having a part operable to come into contact with the one surface of the enclosure member;

a second enclosure member holding portion extending along the opposite surface of the enclosure member and having a part operable to come into contact with the opposite surface of the enclosure member, the second enclosure member holding portion being pivotally supported on the support portion;

a first lid holding portion extending along one surface of the lid and having a part operable to come into contact with the one surface of the lid; and a first locking portion for disengageably locking the second enclosure member holding portion.

2. An inspection opening frame according to claim 1, further comprising two or more frame components each having the same construction.

3. An inspection opening frame according to claim 2, wherein adjacent ones of the plurality of frame components are connected by a coupling member.

4. An inspection opening frame according to claim 2, wherein the second enclosure member holding portion is disposed on an inside of the enclosure member, and the first lid holding portion is disposed on an inside of the lid.

5. An inspection opening frame according to claim 4, wherein the length of the second enclosure member holding portion is so set as to correspond to a dimension of the inspection opening.

6. An inspection opening frame according to claim 4, wherein the enclosure member defines a ceiling wall.

7. An inspection opening frame according to claim 1, wherein the frame component further includes:

a second lid holding portion extending along the opposite surface of the lid and having a part operable to come into contact with the opposite surface of the lid, the second lid holding portion being pivotally supported on the support portion; and a second locking portion for disengageably locking the second lid holding portion.

8. An inspection opening frame according to claim 7, further comprising two or more frame components each having the same construction.

9. An inspection opening frame according to claim 8, wherein adjacent ones of the plurality of frame components are connected by a coupling member.

10. An inspection opening frame according to claim 9, wherein the first enclosure member holding portion and the first lid holding portion have the same shape and are symmetrically arranged with respect to the support portion, and the second enclosure member holding portion and the second lid holding portion have the same shape and are symmetrically arranged with respect to the support portion.

11. An inspection opening frame according to claim 10, wherein the second enclosure member holding portion is disposed on an outside of the enclosure member, and the length of the second enclosure member holding portion is so set as to correspond to a dimension of the inspection opening.

12. An inspection opening frame according to claim 7, wherein the first enclosure member holding portion and the first lid holding portion have the same shape and are symmetrically arranged with respect to the support portion, and the second enclosure member holding portion and the second lid holding portion have the same shape and are symmetrically arranged with respect to the support portion.

13. An inspection opening frame according to claim 12, wherein the second enclosure member holding portion is disposed on an outside of the enclosure member, and the length of the second enclosure member holding portion is so set as to correspond to a dimension of the inspection opening.

14. An inspection opening frame according to claim 7, wherein the enclosure member defines a standing wall.

* * * * *